US010197353B2

(12) United States Patent
Lewis et al.

(10) Patent No.: US 10,197,353 B2
(45) Date of Patent: Feb. 5, 2019

(54) RECEIVER WITH AN AMBIDEXTROUS BOLT STOP

(71) Applicant: KRL Holding Company, Inc., Milan, IL (US)

(72) Inventors: Karl R. Lewis, Davenport, IA (US); Douglas Olson, Huntsville, AR (US); Michael Neff, Moline, IL (US); Michael Nawrocki, Coal Valley, IL (US); John J. Smith, East Moline, IL (US)

(73) Assignee: KRL Holding Company, Inc., Milan, IL (US)

( * ) Notice: Subject to any disclaimer, the term of this patent is extended or adjusted under 35 U.S.C. 154(b) by 0 days.

(21) Appl. No.: 15/472,346

(22) Filed: Mar. 29, 2017

(65) Prior Publication Data

US 2017/0284761 A1 Oct. 5, 2017

Related U.S. Application Data

(60) Provisional application No. 62/315,179, filed on Mar. 30, 2016.

(51) Int. Cl.

| | |
|---|---|
| ***F41A 3/00*** | (2006.01) |
| ***F41A 35/06*** | (2006.01) |
| ***F41A 3/66*** | (2006.01) |
| ***F41A 3/68*** | (2006.01) |
| ***F41A 3/72*** | (2006.01) |
| ***F41A 17/36*** | (2006.01) |
| *F41A 17/42* | (2006.01) |

(52) U.S. Cl.
CPC ..... *F41A 35/06* (2013.01); *F41A 3/66* (2013.01); *F41A 3/68* (2013.01); *F41A 3/72* (2013.01); *F41A 17/36* (2013.01); *F41A 17/42* (2013.01)

(58) Field of Classification Search
USPC ..... 89/181, 138, 153; 42/69.02
See application file for complete search history.

(56) References Cited

U.S. PATENT DOCUMENTS

| | | | | |
|---|---|---|---|---|
| 7,661,219 | B1 | 2/2010 | Knight | |
| 8,261,652 | B2 * | 9/2012 | Findlay | F41A 35/06 42/70.02 |
| 8,359,966 | B1 * | 1/2013 | Brotherton | F41A 17/36 42/70.02 |
| 8,984,786 | B2 | 3/2015 | Underwood | |
| 9,494,378 | B2 * | 11/2016 | Gomez | F41A 35/06 |
| 9,664,469 | B2 * | 5/2017 | DiChario | F41A 9/70 |

(Continued)

FOREIGN PATENT DOCUMENTS

DE 10 2012 019 422 B3 4/2014

*Primary Examiner* — J. Woodrow Eldred
(74) *Attorney, Agent, or Firm* — Woodard, Ernhardt, Moriarty, McNett & Henry LLP

(57) ABSTRACT

Disclosed is a lower receiver that defines an aperture extending between a bolt stop well and an actuator well, the lower receiver including a bolts stop and a first actuator lever on one side of the lower receiver and a bolt stop actuator that includes a tooth that extends through the aperture, a second bolt release lever on the other side of the lower receiver and a rod connecting the tooth and the second bolt release lever, wherein the tooth engages the bolt stop so that actuation of the second bolt release lever moves the bolt stop and where the first and second release levers move in unison.

20 Claims, 10 Drawing Sheets

(56) References Cited

U.S. PATENT DOCUMENTS

| | | | |
|---|---|---|---|
| 9,810,493 | B2 | 11/2017 | Fluhr et al. |
| 2012/0167424 | A1 | 7/2012 | Gomez |
| 2015/0323271 | A1 | 11/2015 | McGinty |

* cited by examiner

RECEIVER WITH AN AMBIDEXTROUS BOLT STOP

CROSS-REFERENCE TO RELATED APPLICATIONS

This application claims the benefit of U.S. Provisional Application No. 62/315,179, filed Mar. 30, 2016, which is hereby incorporated by reference.

BACKGROUND

This disclosure is in the field of firearms and, more particularly, to an ambidextrous bolt stop for use with a firearm.

Many automatic firearms include magazines holding multiple rounds of ammunition. In many semi-automatic and automatic firearms, a bolt reciprocates over the magazine with each firing, unloading fired casings from a chamber when moving rearwardly and stripping and chambering a new round from the magazine during the reciprocal forward movement. Many firearms include a bolt stop (also known as a bolt catch) that holds the bolt in the rearward position when the magazine is empty (so there is no round to strip and chamber). Retaining the bolt in a rearward position permits the empty magazine to be removed and replaced with a loaded magazine (or in other firearms with fix magazines, permits additional rounds to be loaded into the magazine). Once a loaded magazine is present, the firearm can be prepared for firing by releasing the bolt catch, resulting in a round being chambered. This is well known in the art.

The M16/AR15 platform is a well-known semi-automatic/automatic firearm in wide military and civilian use. The lower receiver of the M16/AR15 includes a bolt stop release button positioned on the left side of the firearm. While the left side positioning of the bolt stop release button is convenient for right-handed operators, the left side positioning can be awkward for left-handed operators. The left side positioning can also be inconvenient for right-handed operators who might switch there shooting style based on combat conditions.

The object of this disclosure is to provide a right side bolt stop release button that works in concert with the left side release button to actuate the bolt stop and provide ambidextrous functionality. While the improvements disclosed below are made to the M16/AR15 platform, these improvements could also be used to improve other firearms.

DESCRIPTION OF THE ILLUSTRATED EMBODIMENTS

Figure 1:
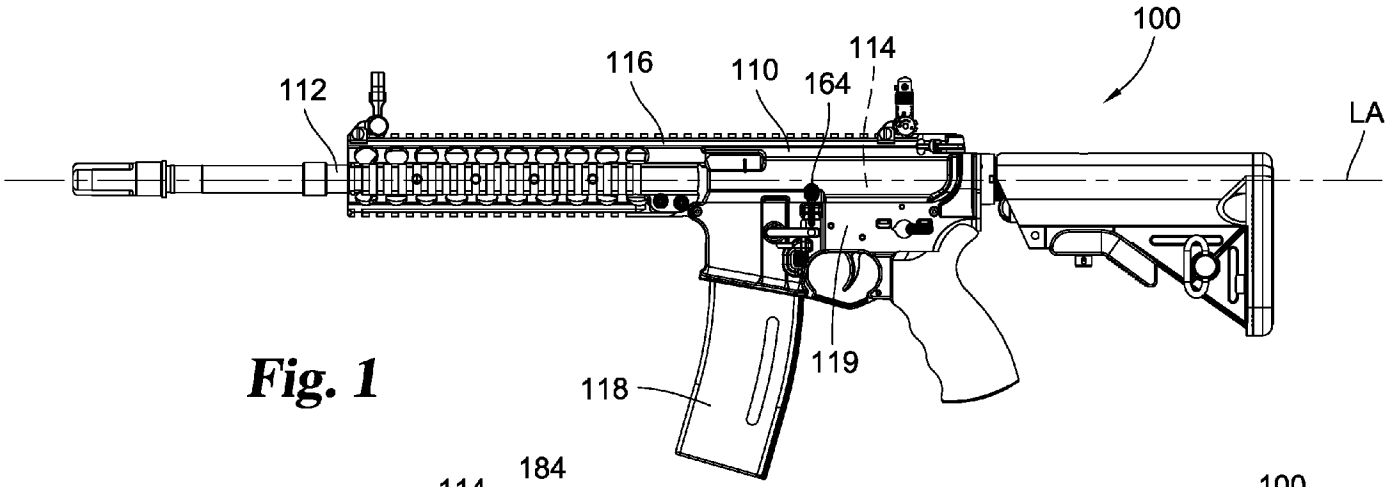
FIG. 1 is a left side elevational view of a firearm incorporating a lower receiver assembly.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

With respect to the specification and claims, it should be noted that the singular forms "a", "an", "the", and the like include plural referents unless expressly discussed otherwise. As an illustration, references to "a device" or "the device" include one or more of such devices and equivalents thereof. It also should be noted that directional terms, such as "up", "down", "top", "bottom", and the like, are used herein solely for the convenience of the reader in order to aid in the reader's understanding of the illustrated embodiments, and it is not the intent that the use of these directional terms in any manner limit the described, illustrated, and/or claimed features to a specific direction and/or orientation.

Figure 2:
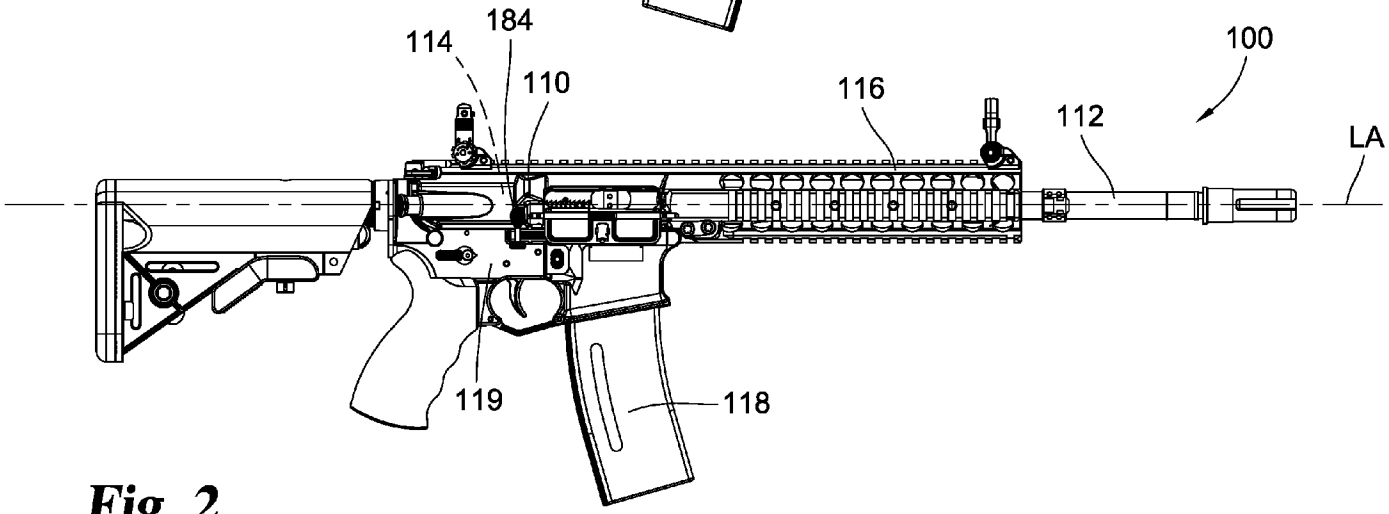
FIG. 2 is a ride side elevational view of the FIG. 1 firearm.
Figure 3:
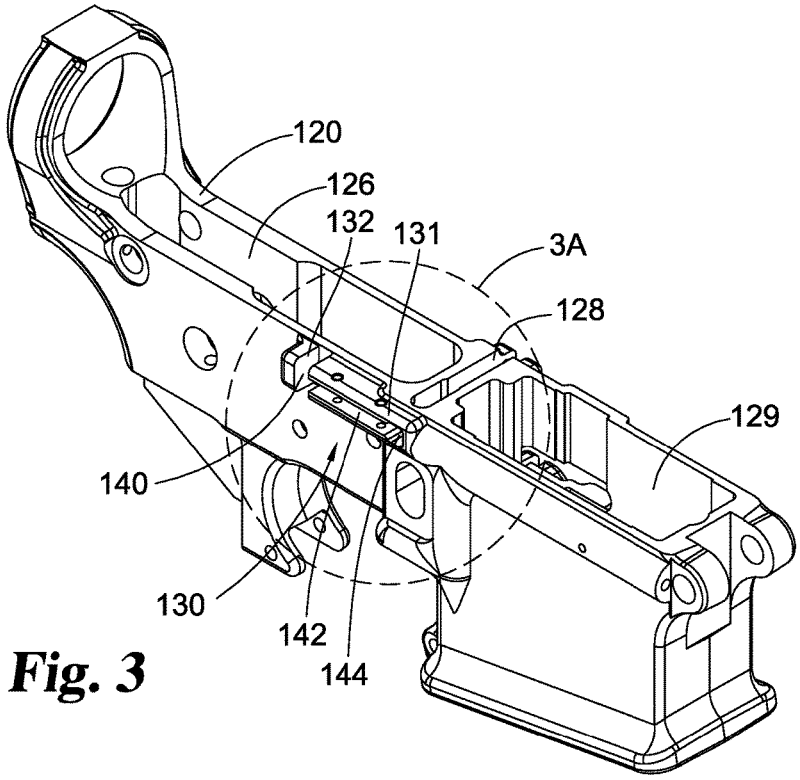
FIG. 3 is a perspective view of a lower receiver body, a component of the FIG. 1 lower receiver assembly.
Figure 3A:
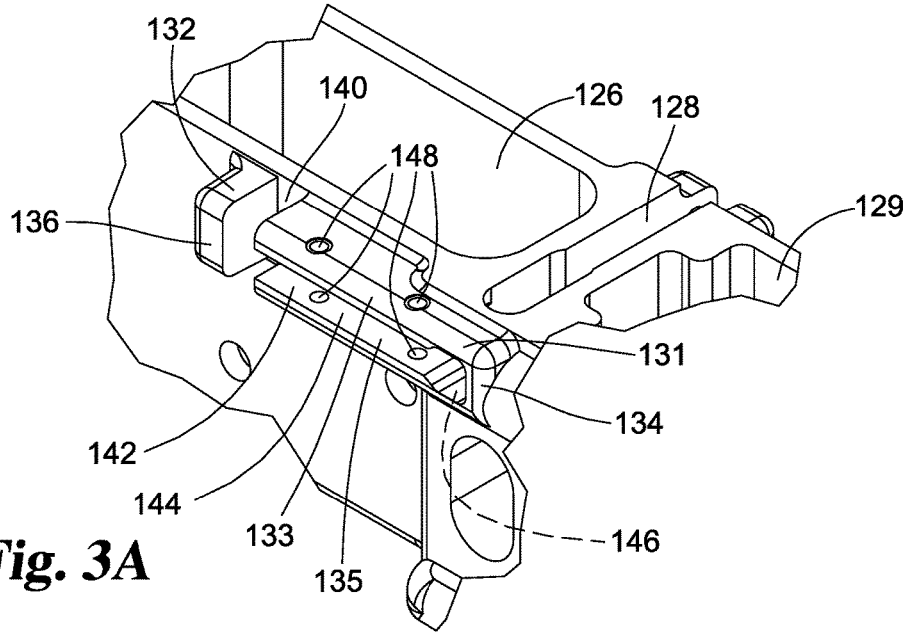
FIG. 3*a* is an enlarged view of a portion of the FIG. 3 lower receiver body delineated by line 3*a*.
Figure 4:
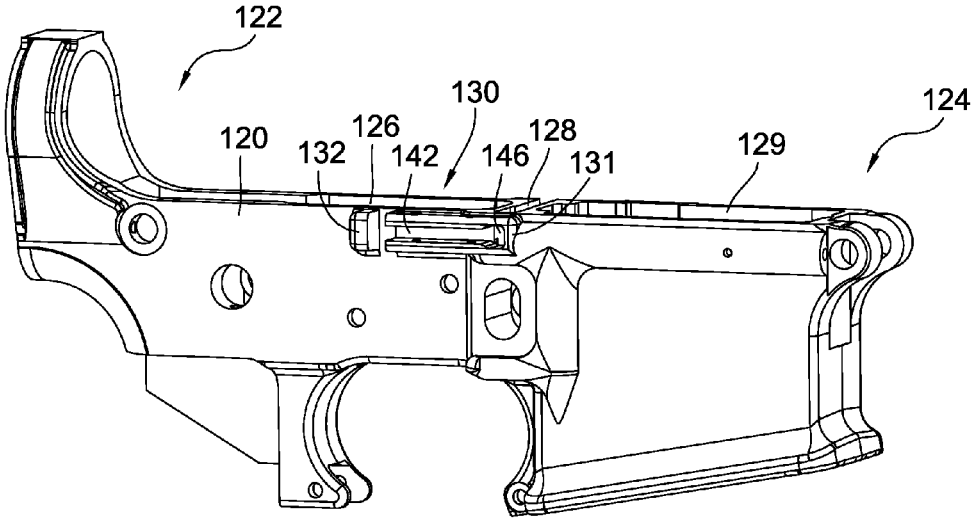
FIG. 4 is a perspective view of the FIG. 3 lower receiver body.

Referring to FIGS. 1-2, a firearm 100 is illustrated. Firearm 100 generally includes upper receiver 110, barrel 112, bolt carrier group 114 (not illustrated but positioned within upper receiver 110), magazine 118 and lower receiver assembly 119.

Upper receiver 110 in the illustrated embodiment incorporates an integral handguard portion 116 that extends forwardly of upper receiver 110. This configuration of an upper receiver is described in U.S. Pat. No. 8,234,808. Upper receiver 110 is removably attached to lower receiver assembly 119. Together upper receiver 110 and lower receiver assembly 119 cooperate to prevent operation of firearm 100.

Lower receiver assembly 119 includes bolt release lever 164 as is well known in the art. Bolt release lever 164 is positioned on the left side of firearm 100. Lower receiver assembly 119 also includes bolt release lever 184 positioned on the right side of firearm 100. Inclusion of bolt release lever 184 on the right of firearm 100 is the subject of the improvement to lower receiver assembly 119 described below.

Firearm 100 could be generally classified as an M16/AR15 type weapon in that many components are interchangeable with a stock M16 or AR15 weapon. For example, bolt carrier group 114, and magazine 118 could be freely interchanged with a stock magazine or bolt carrier group from a stock M16 or AR15 weapon. Similarly, upper receiver 110 is adapted to be used with any stock lower receiver assembly for an AR15 or M16 type weapon. Similarly, the illustrated lower receiver assembly 119 could be used with any stock upper receiver for an M16 or AR15. So while the illustrated firearm 100 is not a M16 or AR15 type weapon it could generally be classified as an AR15 weapon because many of its components are interchangeable with AR15 type weapons.

Similarly, while the illustrated firearm 100 may be chambered for use with 5.56×45 mm NATO ammunition the same configuration could be used with weapons chambered with other calibers such as 7.62×51 mm NATO, 300 ACC Blackout or .308 Winchester.

While the improvements to lower receiver assembly 119 disclosed below are disclosed specifically as related to the configuration of a M16/AR15 lower receiver, the same technology could be applied to other receivers that have similarly configured components.

Referring now to FIGS. 3, 3*a* and 4-6, lower receiver body 120 is illustrated. Lower receiver body 120 is the outer housing/casting that defines the outer housing and many of the parts of lower receiver assembly 119 illustrated in FIGS. 1-2. Lower receiver body 120 has a proximal end 122 (closest to the operator during firing/the rear of the weapon), and distal end 124 (the end positioned further away from the operator during firing/the end towards the barrel). Lower receiver body 120 defines trigger well 126, bolt stop well 128, and magazine well 129 with wall 127 positioned between bolt stop well 128 and magazine well 129. Trigger well 126 is adapted to receive a trigger group. Bolt stop well 128 is adapted to receive a bolt stop and magazine well 129 is adapted to receive magazine 118.

Figure 5:
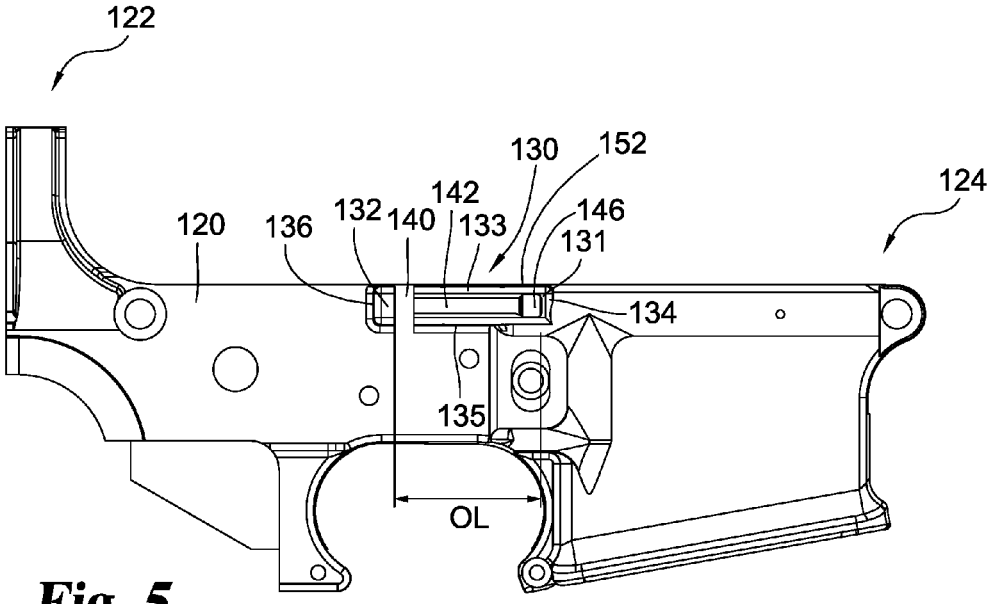
FIG. 5 is a right side elevational view of the FIG. 3 lower receiver body.
Figure 6:
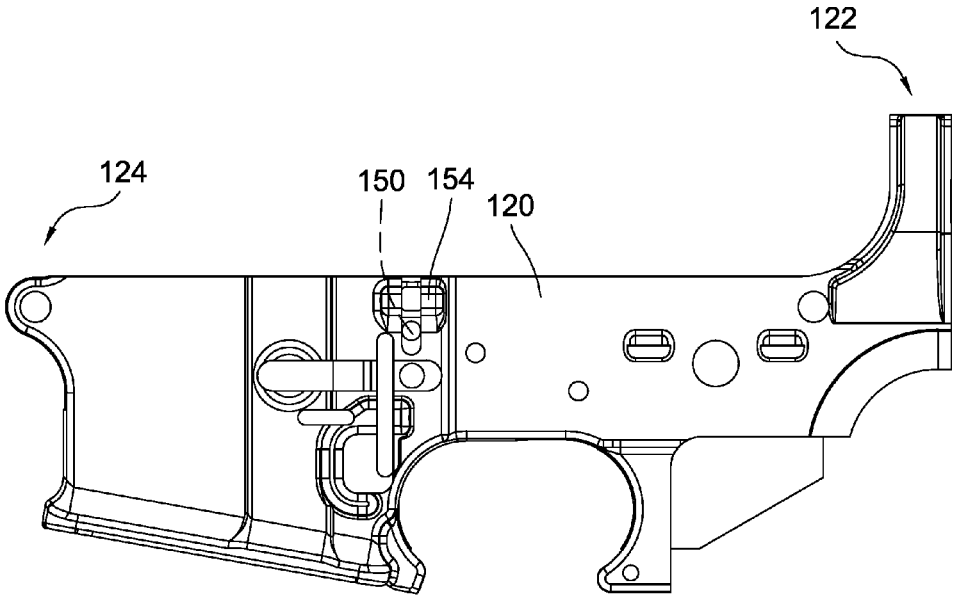
FIG. 6 is a left side elevational view of the FIG. 3 lower receiver body.

Lower receiver body 120 also includes actuator housing 130 and bolt stop housing 154. Actuator housing 130 is a protrusion off the right side of lower receiver body 120 that includes front portion 131 and rear portion 132. Front portion 132 includes top wall 133, front wall 134 and bottom wall 135 while rear portion 132 includes rear wall 136. Actuator housing 130 also defines gap 140 between front portion 132 and rear portion 132. Together front portion 132 and rear portion 132 of actuator housing 130 define actuator well 142 having aperture 144. Lower receiver 120 also includes opening 146 that extends between actuator well 142 and bolt stop well 128. Opening 146 is positioned below top surface 152 with top surface 152 being continuous and uninterrupted across a longitudinal length of bolt stop 160 above opening 146. As shown in FIG. 5, actuator well 142 has an overall length between front wall 134 and rear wall 136 of OL.

Actuator housing 130 also defines a plurality of holes 148 positioned in top wall 133 and bottom wall 135. As described in greater detail below holes 148 are adapted to receive pins to secure a bolt stop actuator within actuator well 142.

Figure 7:
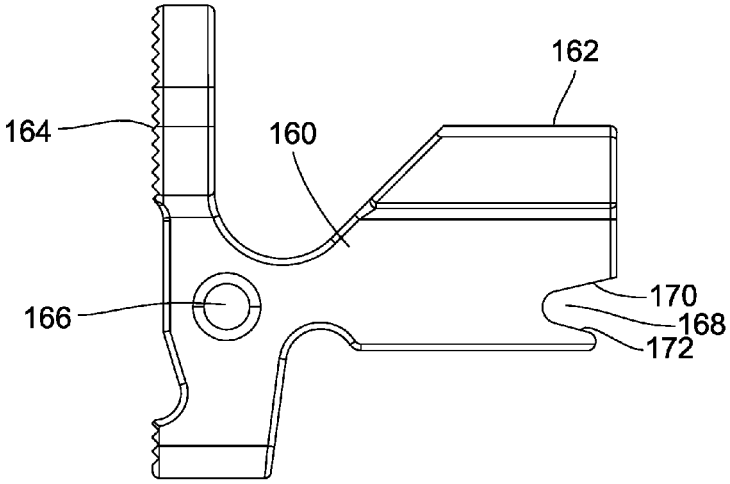
FIG. 7 is a front elevational view of a bolt stop, a component of the FIG. 1 lower receiver assembly.
Figure 8:
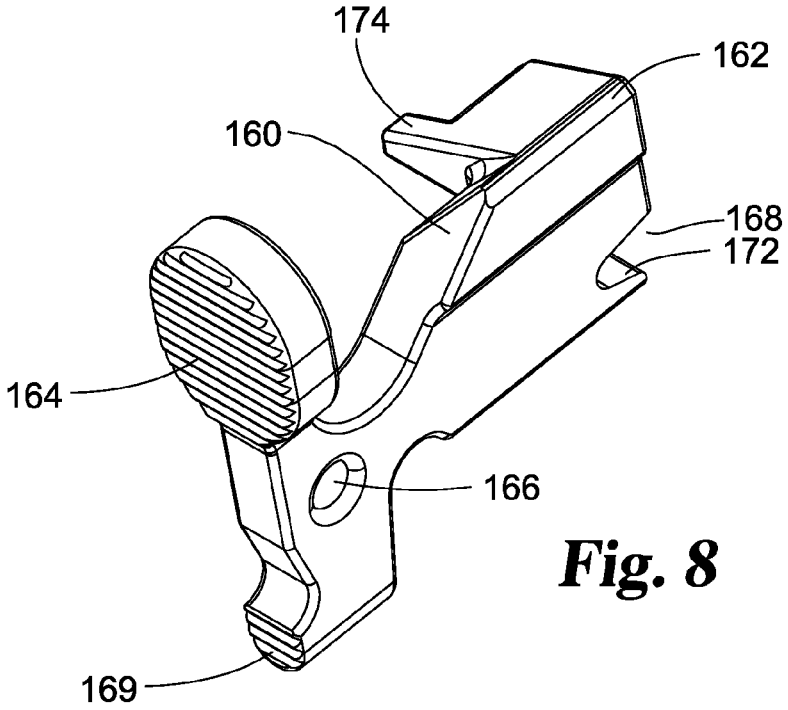
FIG. 8 is a top front perspective view of the FIG. 7 bolt stop.
Figure 9:
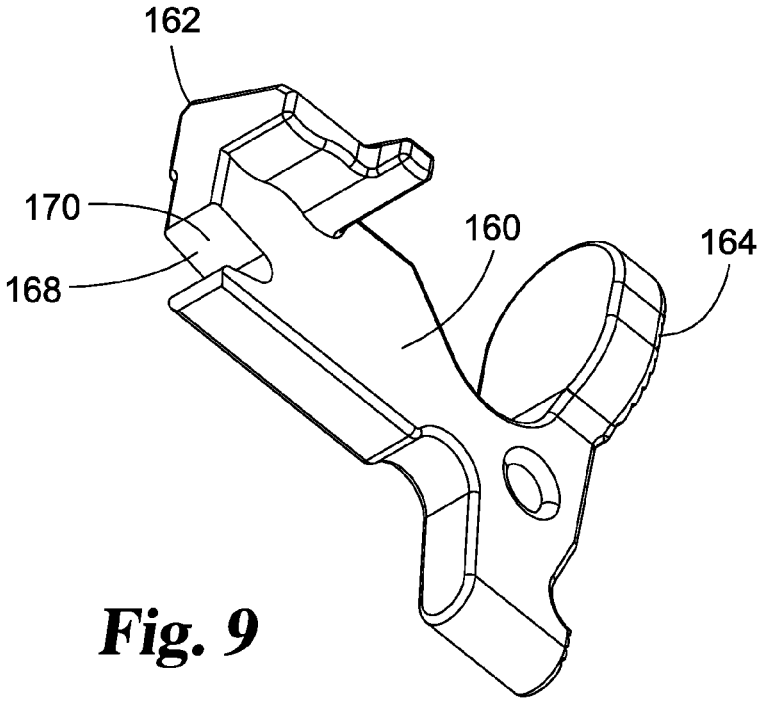
FIG. 9 is a bottom rear perspective view of the FIG. 7 bolt stop.

Referring now to FIGS. 7-9, bolt stop 160 is illustrated. Bolt stop 160 generally includes projection 162, bolt release lever 164, pivot hole 166, notch 168 and projection 174. Bolt release lever 164 includes button 165 and button 169. Notch 168 includes surface 170 on the top of the notch and surface 172 on the bottom of the notch. The illustrated bolt stop 160 generally conforms to the size and shape of a standard M16/AR15 type bolt stop (other than the inclusion of notch 168). As such bolt stop 160 would be usable with and interchangeable with standard AR15/M16 bolt stops.

The operation of bolt stop 160 is well known in the art. Projection 174 extends over the top of wall 127 extending over magazine well 129. When a magazine empties an interface on the magazine engages projection 174 and pushes it upward, causing bolt stop 160 to rotate about pivot hole 166 and extending projection 162 into the path of bolt carrier group 114 to retain bolt carrier group 114 in a rearward position to allow magazine 118 to be changed.

Figure 10:
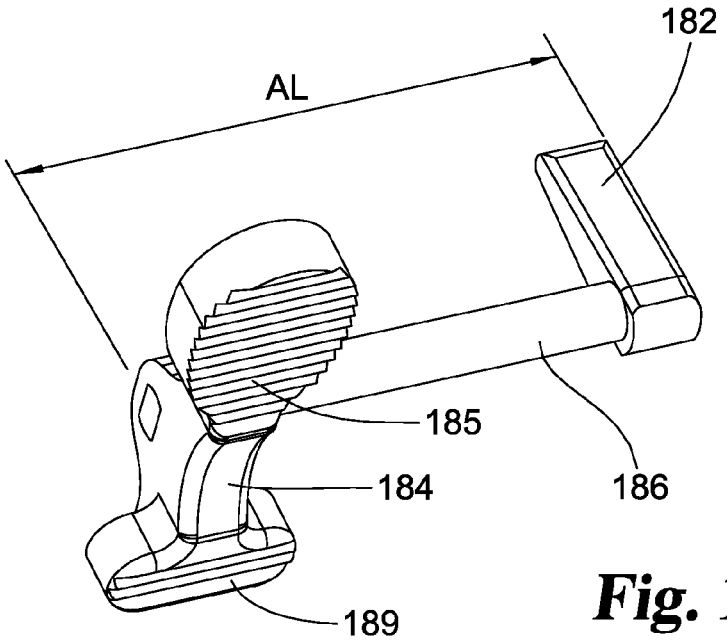
FIG. 10 is a perspective view of a bolt stop actuator, a component of the FIG. 1 lower receiver assembly.

Referring to FIG. 10, bolt stop actuator 180 is illustrated. Bolt stop actuator 180 generally includes tooth 182, bolt release lever 184, and rod 186 connecting tooth 182 to bolt release lever 184. Bolt release lever 184 includes button 185 and button 189. Bolt stop actuator 180 has a bolt stop actuator length AL between the outer edge of tooth 182 and the outer edge of bolt release lever 184

Figure 11:
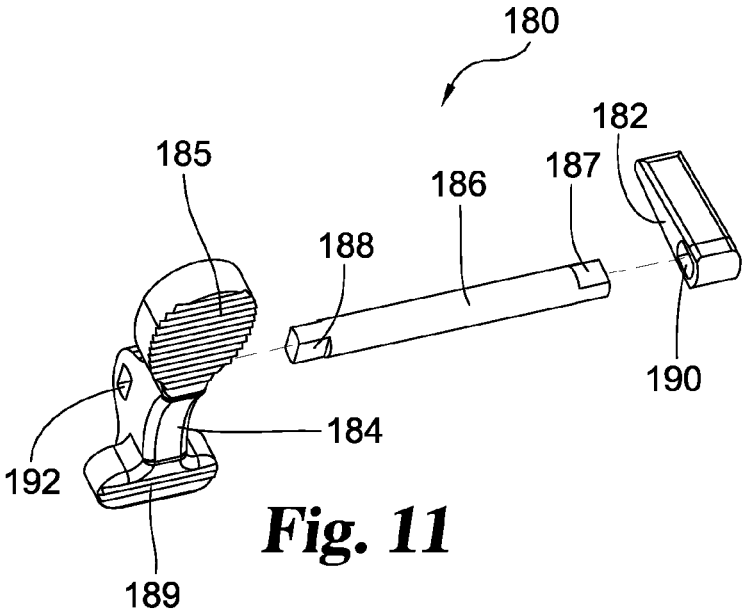
FIG. 11 is an assembly view of the FIG. 10 bolt stop actuator.
Figure 12:
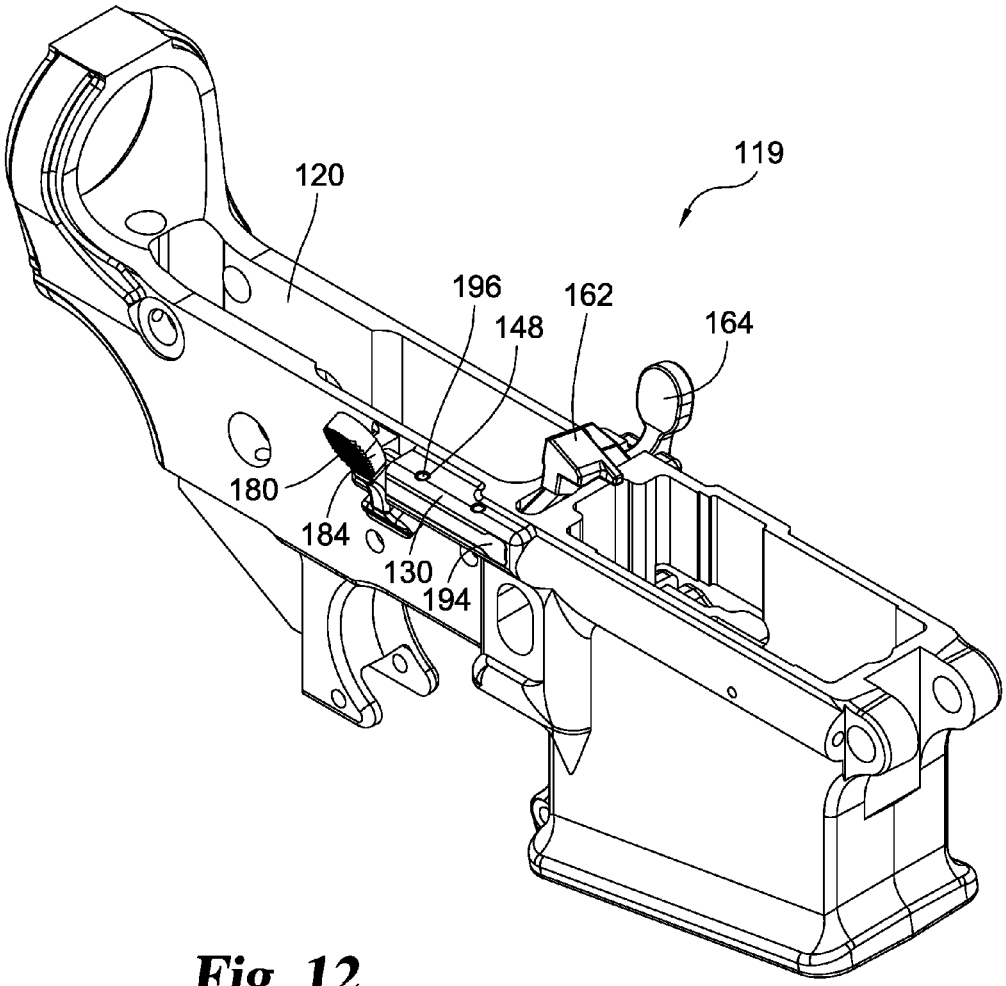
FIG. 12 is a perspective view of the FIG. 1 lower receiver assembly.

Referring to FIG. 11, one embodiment of the assembly of bolt stop actuator 180 is illustrated. In the illustrated embodiment, tooth 182 includes cavity 190, rod 186 includes end 187 and end 188 with bolt release lever 184 includes cavity 192. Both ends 187 and 188 have non-cylindrical geometries. Cavity 190 is adapted to receive end 187 in a non-rotational manner. Similarly, cavity 192 is adapted to receive end 188 in a non-rotational manner (both cavities 190 and 192 include matching non-circulator geometries that correspond to ends 187 and 188 of rod 186). The embodiment of bolt stop actuator 180 illustrated in FIG. 11 can be assembled by press fitting the components together. In alternative embodiments, one or more of tooth 182, bolt release lever 184 and/or rod 186 may be integrally unitarily constructed of a single piece or components may be assembled together using alternative methods such as welding.

Figure 13:
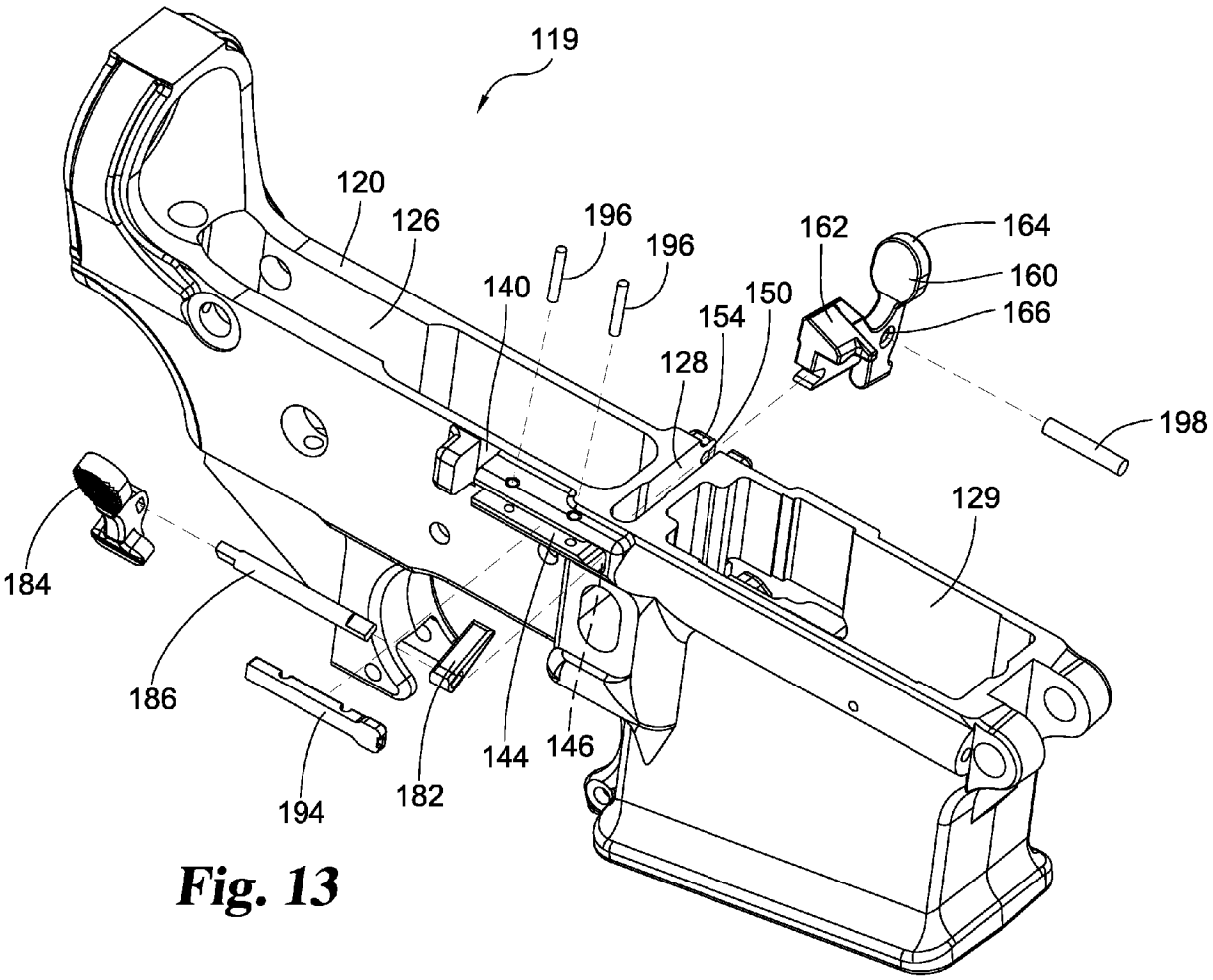
FIG. 13 is an exploded assembly view of the FIG. 12 lower receiver assembly.
Figure 14:
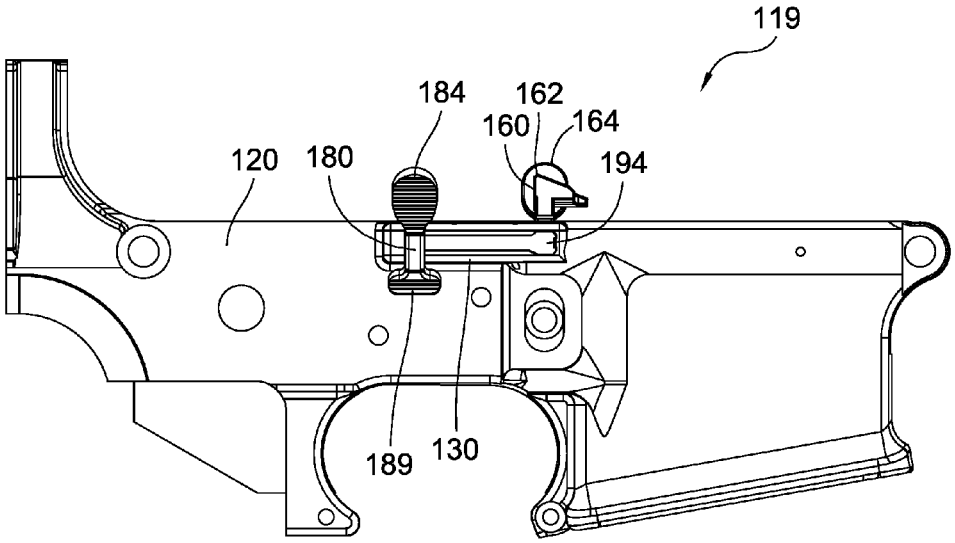
FIG. 14 is a right side elevational view of the FIG. 12 lower receiver assembly.
Figure 15:
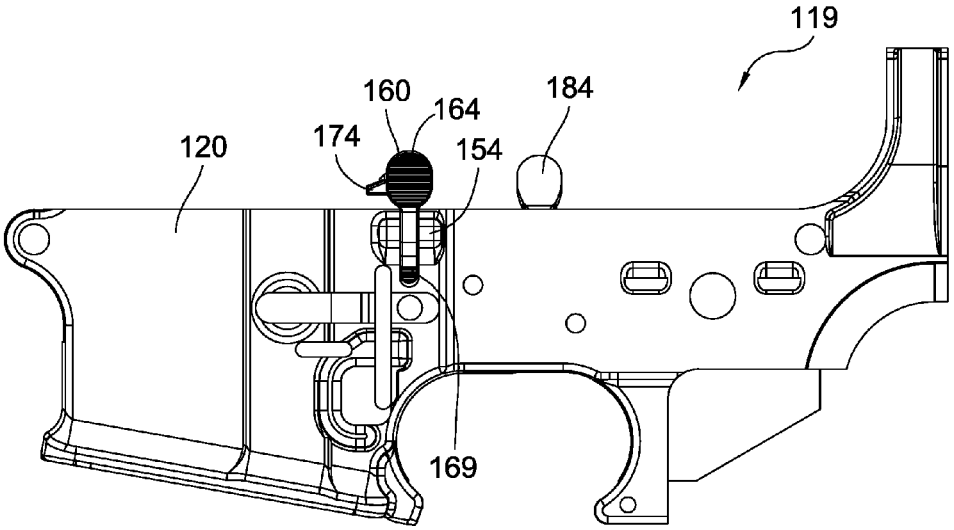
FIG. 15 is a left side assembly view of the FIG. 12 lower receiver assembly.

Referring now to FIGS. 12-15, lower receiver assembly 119 is illustrated with bolt stop 160 and bolt stop actuator 180 assembled on lower receiver body 120. The assembly of lower receiver assembly 119 is best shown in FIG. 13 illustrates shows an exploded assembly view. Bolt stop 160 is received in bolt stop housing 154 with a portion of bolt stop 160 residing in bolt stop well 182 with pin 198 extending through bolt stop housing 154 and pivot hole 166 to pivotally secure bolt stop 160 to lower receiver body 120 with bolt stop 160 adapted to pivot relative to lower receiver body 120.

Bolt stop actuator 180 is assembled with release lever 184 and tooth 182 attached to rod 186. Bolt stop actuator 180 is positioned in aperture 144 with tooth 182 extending through opening 146 and engaging notch 168 on bolt stop 160. Opening 146 is configured to closely fit tooth 182 with sufficient clearance to permit bolt stop actuator 180 to pivot as disclosed below while minimizing the required gaps between tooth 182 and opening 146. Bolt release lever 184 is positioned in gap 140. Pins 196 are inserted into holes 148 to secure rod 186 (and bolt stop actuator 180) within actuator well 142 while permitting road 186 to rotate within aperture 144 relative to lower receiver body 170. Front wall 134 and rear wall 136 are solid and block movement of bolt stop actuator 100 longitudinally pass either front wall 134 or rear wall 136. Cover 194 is positioned in opening 146 to substantially cover opening 146 and actuator well 142.

Opening length OL is longer than bolt actuator length AL such that an entire longitudinal length of bolt stop actuator 180 is received in aperture 144. This allows bolt stop actuator 180 to be inserted and removed from lower receiver body 120 with bolt stop actuator 180 integrally formed or assembled. This configuration also permits bolt stop actuator 180 to be inserted or removed from receiver body 120 with lower receiver assembly 119 coupled to upper receiver 110.

Figure 17:
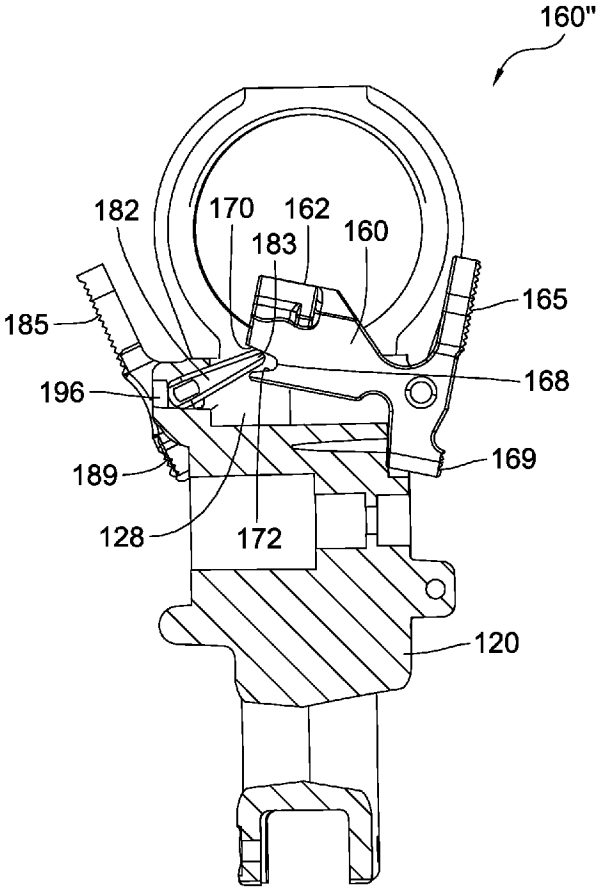
FIG. 17 is a front cross sectional view of the FIG. 12 lower receiver assembly with the bolt stop in an elevated position.
Figure 16:
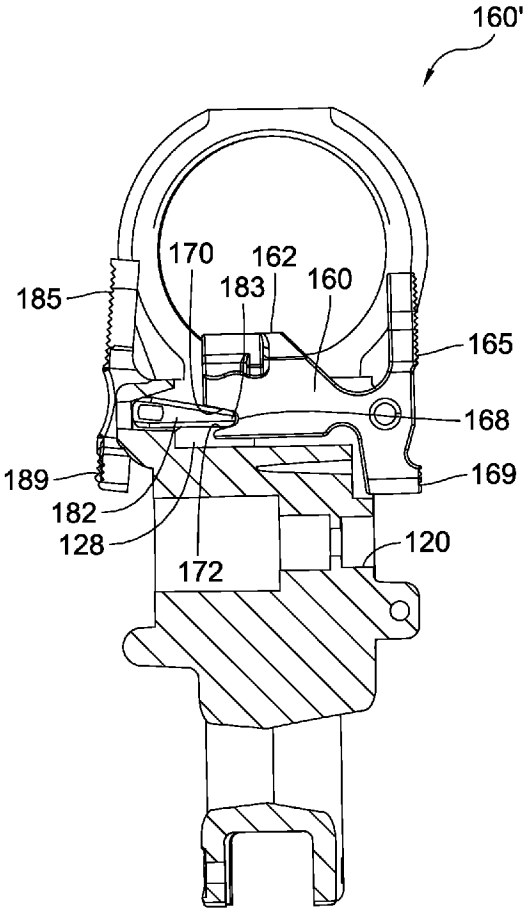
FIG. 16 is a front cross sectional view of the FIG. 12 lower receiver assembly with the bolt stop in a lowered position.

FIGS. 16-17 illustrate the pivoting action of bolt stop 160 and the corresponding pivoting movement of bolt stop actuator 180. Bolt stop actuator 180 is pivotally mounted to lower receiver body 120 because rod 186 is entrapped within actuator well 142 by pins 196. Tooth 182 extends into bolt stop well 128 through opening 146 and engages and resides with end 183 of tooth 182 being positioned in notch 168. As described above, bolt stop 160 is pivotally coupled to lower receiver body 120 via pin 198 that extends through stop housing 154 and pivot hole 166. The engagement of tooth 182 in notch 168 results in bolt stop 160 and bolt stop actuator 180 moving substantially in unison.

FIG. 16 illustrates lowered position 160' where projection 162 is positioned below the path of travel of bolt carrier group 114 such that firearm 100 can freely cycle in a semi-automatic or automatic manner without interference from projection 162. Conversely, FIG. 17 illustrates raised position 160" where projection 162 is raised up into the path of bolt carrier group 114 such that bolt carrier group 114 would be prevented from passing forward over bolt stop 160. Elevated position 160" shown in FIG. 17 may be achieved, for example, by an empty magazine pushing against projection 174 (as described above) or by an operator pressing button 165 or button 185 to move projection 162 upwardly while either cycling the firearm via a charging handle (not labeled) or firing the firearm to cause bolt carrier group 114 to cycle rearwardly. As shown in FIG. 17, in raised position 160", buttons 165 and 185 are extended away from firearm 100 such that actuation of either button 165 or button 185 will pivot bolt stop 160 lowering projection 162 to the lowered position 160'.

As shown in FIGS. 16 and 17, in position 160', tooth 182 abuts button surface 172 while on position 160", tooth 182 is pivoted away from button surface 173. Conversely, tooth 182 abuts top surface 170 in both position 160' and in position 160".

While the disclosure has been illustrated and described in detail in the drawings and foregoing description, the same is to be considered as illustrative and not restrictive in character, it being understood that only certain specific embodiments have been shown and that all changes and modifications that come within the spirit of the disclosure are desired to be protected. Though applicant has described various aspects of the disclosure with respect to specific embodiments, various alternative and modifications will be apparent from the present disclosure that are within the scope and spirit of the present disclosure as set forth herein. Further, it should be understood that any aspects of any of the embodiments disclosed herein or similar aspects or structure may be combined or interchanged.

We claim:

1. A lower receiver for use with an upper receiver that includes a bolt carrier group, wherein the lower receiver is adapted to be removably coupled to the upper receiver, the lower receiver defining:

a trigger well, bolt stop well, an actuator well, a wall extending between the bolt stop well and the actuator well, and an aperture extending through the wall between the bolt stop well and the actuator well, said lower receiver comprising:

a bolt stop comprising a projection and a first bolt release lever coupled to said projection, wherein said bolt stop is pivotally coupled to said lower receiver and is movable between a first position where said projection is positioned to engage the bolt carrier group to retain the bolt carrier group in a rearward position and a second position where said projection is out of a path of travel of the bolt carrier group, wherein said bolt stop is positioned in the bolt stop well; and a bolt stop actuator comprising a tooth, a second bolt release lever and a rod that connects said tooth and said second bolt release lever, wherein said bolt stop actuator is positioned in the actuator well with said tooth extending through the aperture to engage said bolt stop, wherein actuation of said second bolt release lever moves said bolt stop between the first and second positions and wherein the engagement between said tooth and said bolt stop causes said first and second bolt release levers to move in unison.

2. The lower receiver of claim 1, further comprising a fastener that secures the relative position of the bolt stop actuator within the actuator well while permitting rotation of said bolt stop actuator relative to said lower receiver.

3. The lower receiver of claim 1, wherein the actuator well is adapted to insert and remove said bolt stop actuator into and out of said actuator well with said tooth, said second bolt release lever and said rod integrally formed.

4. The lower receiver of claim 1, wherein the actuator well is adapted to insert and remove said bolt stop actuator when said upper receiver is coupled to said lower receiver.

5. The lower receiver of claim 1, wherein the aperture extending between the bolt stop well and the actuator well is positioned below a top surface of said lower receiver such that the top surface is contiguous and uninterrupted across a longitudinal length of the bolt stop above the aperture.

6. The lower receiver of claim 5, wherein the aperture is configured to closely fit said tooth with sufficient clearance for said bolt stop actuator to pivot with said bolt stop between the first and second positions while minimizing the size of gaps between said tooth and the aperture.

7. The lower receiver of claim 5, further comprising a cover that substantially covers the actuator well over said bolt stop actuator.

8. The lower receiver of claim 1, further comprising an actuator housing that extends away from said lower receiver, wherein said actuator housing defines the actuator well.

9. The lower receiver of claim 8, wherein said actuator housing defines an opening that extends longitudinally along said actuator housing, wherein the opening is long enough to receive an entire longitudinal length of said bolt stop actuator.

10. The lower receiver of claim 8, further comprising a pin affixed through said actuator housing across the actuator well which secure the relative position of the bolt stop actuator within the actuator well while permitting rotation of said bolt stop actuator relative to said lower receiver.

11. The lower receiver of claim 8, wherein a distal side of said actuator housing is solid such that the distal side of said actuator housing blocks said bolt stop actuator from moving longitudinally pass the distal side of said actuator housing.

12. The lower receiver of claim 1, wherein said tooth and said rod are press fit together.

13. The lower receiver of claim 12, wherein said tooth defines a first opening having a non-cylindrical shape and said rod has a first end that defines a matching shape such that said tooth and said rod are rotationally fixed together after being press fit together.

14. The lower receiver of claim 12, wherein said second bolt release lever and said rod are press fit together.

15. The lower receiver of claim 14, wherein said second bolt release lever defines a second opening having a non-cylindrical shape and said rod has a second end that defines a matching shape such that said second bolt release lever and said rod are rotationally fixed together after being press fit together.

16. The lower receiver of claim 1, wherein no portion of said bolt stop actuator is in into the trigger well.

17. The lower receiver of claim 1, wherein said bolt stop defines a notch, a first surface and a second surface, wherein said tooth abuts said first surface when said bolt stop is in the first position, wherein said tooth abuts said second surface when said bolt stop is in the second position, and wherein said tooth does not bear against said first surface when said bolt stop is in the second position.

18. The lower receiver of claim 1, wherein the lower receiver is adapted to receive an M16 upper receiver.

19. A firearm comprising:

an upper receiver comprising a bolt carrier group;

a barrel coupled to said upper receiver; and the lower receiver of claim 1.

20. The firearm of claim 19, wherein said upper receiver an M16 upper receiver.

* * * * *